United States Patent [19]

Moriyama et al.

[11] Patent Number: 4,627,755

[45] Date of Patent: Dec. 9, 1986

[54] PLATEN OF A PRINTER

[75] Inventors: Masaru Moriyama; Yoshio Yamaguchi, both of Tokyo, Japan

[73] Assignee: Janome Sewing Machine Co., Ltd., Tokyo, Japan

[21] Appl. No.: 668,075

[22] Filed: Nov. 5, 1984

[30] Foreign Application Priority Data

Nov. 10, 1983 [JP] Japan ..... 58-173148[U]

[51] Int. Cl.[4] ..... B41J 11/02; B41J 11/04; B41J 11/057

[52] U.S. Cl. ..... 400/662; 400/470; 400/657; 400/661.2; 400/661.3

[58] Field of Search ..... 400/662, 124, 470, 471.1, 400/657, 661.3, 663, 661.2

[56] References Cited

U.S. PATENT DOCUMENTS

| | | | |
|---|---|---|---|
| 4,210,917 | 7/1980 | Lane, III | 400/470 X |
| 4,386,861 | 6/1983 | Kurihara et al. | 400/124 |
| 4,458,257 | 7/1984 | Lane, III | 400/470 X |
| 4,494,886 | 1/1985 | Kondo et al. | 400/212 X |

FOREIGN PATENT DOCUMENTS

| | | | |
|---|---|---|---|
| 55-154193 | 12/1980 | Japan | 400/240.3 |
| 56-33972 | 4/1981 | Japan | 400/144.2 |
| 2100673 | 1/1983 | United Kingdom . | |

OTHER PUBLICATIONS

"Color Wheel With Inked Platens" by F. R. Humphreys, *IBM Technical Disclosure Bulletin,* vol. 25, No. 4, Sep. 1982, p. 2193.

*Primary Examiner*—Edgar S. Burr
*Assistant Examiner*—Moshe I. Cohen
*Attorney, Agent, or Firm*—Michael J. Striker

[57] ABSTRACT

A printing color indicating member is furnished to a non-printing portion of an ink impregnated porous substance body, so that a desired printing color can be exactly designated, and the porous substance body of the desired color may be easily chosen, irrespectively of the colored outer appearance of the ink impregnated porous substance body. The color indicating member being higher in density than the ink impregnated porous substance.

4 Claims, 6 Drawing Figures

PLATEN OF A PRINTER

FIELD OF THE INVENTION

The present invention relates to a printer, and more particularly to a platen of an ink impregnated type thereof, in which the printer which includes members composed of porous substances for impregnating color inks and non-printing parts thereof, is provided at the latter with members for indicating printing colors, so that a desired ink impregnating body is instantly chosen.

BACKGROUND OF THE INVENTION

As the printer in an output device of a terminal data communication output machine or computer, widely used is a so-called impact printer of an ink ribbon system for printing on the paper by selectively giving impact to the platen via the ink ribbon and the paper.

Especially, use of a dot matrix printer using wires as the letter printing element has been widespread, since it is small in size and economical.

However, the printer of the ink ribbon system needs to attach an ink ribbon cassette and move it, and accordingly the mechanism is complicated, and especially in the case of printing of various colors the mechanism is made more complicated.

Since the printer have been used in various fields, not only black but also other colors have been demanded. In the ink ribbon system, it is necessary to prepare a number of the printing heads in accordance with the number of colors of the ribbons. Accordingly, this system is mechanically complicated and therefore very costly.

An impact printer that is mechanically simple and prints easily without bringing about the shortcomings of the ink ribbon printer has been developed as seen in FIG. 1 of the attached drawings.

In reference to FIG. 1, porous bodies 5 are impregnated with a plurality of color of ink, and constitute a platen 4 of cylindrical shape which is to be attached opposite to a printing head 1 having wires 2 serving as letter or character printing elements via a printing paper. The platen 4 is rotated and the ink impregnated porous body 5 of a desired color is selected as a printing face. When the printing face is given impact via the printing paper 3 by the wire 2, a printing of the desired color is made on the paper 3.

The platen 4 is formed with the printing face by detachably attaching the ink impregnated porous bodies 5 to a platen base 7 as seen in FIG. 2 thereby making it easy to exchange the bodies 5 in case the ink is used up or any of the bodies are damaged. Further, it is possible to exchange one set of the platen having the ink impregnated elements of other different colors.

In the embodiment shown in FIG. 2, magnets 9 are employed as means for attaching the ink impregnated porous bodies 5 to the platen base 7. The magnetic piece 9 is positioned into a groove 8*a* defined in an attaching face 8 of the platen base 7, and on the other hand the ink impregnated porous body 5 is secured at its bottom with an iron plate 6 and is attached to the platen base 7 due to magnetic attraction.

The porous body is in general composed of a sintered material of polyamide resin of around 0.70 to 0.85 in density which is impregnated with ink. In printing, depending on the density, either durability or formability are provided. When a large quantity of ink is contained therein, the body reveals a color darker than the one actually used.

Therefore, it is not easy to distinguish a desired color for the printing paper from the outer appearance of the ink impregnated porous body.

Further, in such a case that the porous body is impregnated with light colors such as yellow, red or light blue, its surface is often stained with darker ink such as black, purple or dark blue. This stain does not give bad influences to the printing at all, but the porous color body is made unsightly.

For removing such bad conditions, it is assumed that the porous body itself is made black, which makes the color of the impregnated ink absolutly unclear.

SUMMARY OF THE INVENTION

In view of such circumstances, it is an object of this invention to provide an ink impregnated platen of a printer which distinctly shows the printing color impregnated in the porous bodies.

Pursuant to this object, and others which will become apparent hereafter, one aspect of the invention resides in the ink impregnated porous bodies being provided, at non-printing parts thereof, with printing color indicating members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS OF THE INVENTION

The present printer is of an ink impregnated platen system, and is attached, at its platen base, with ink impregnated porous bodies of a plurality of colors in order to provide printing faces, and more particularly said ink impregnated porous bodies are provided, at non-printing parts thereof, with printing color indicating members.

Figure 1:
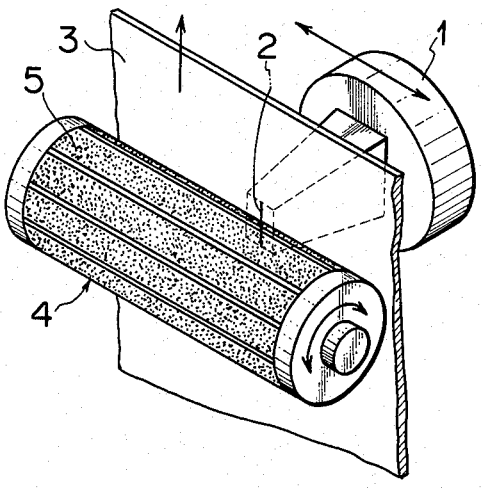
FIG. 1 is a perspective view of a platen of an ink impregnated type.
Figure 2:
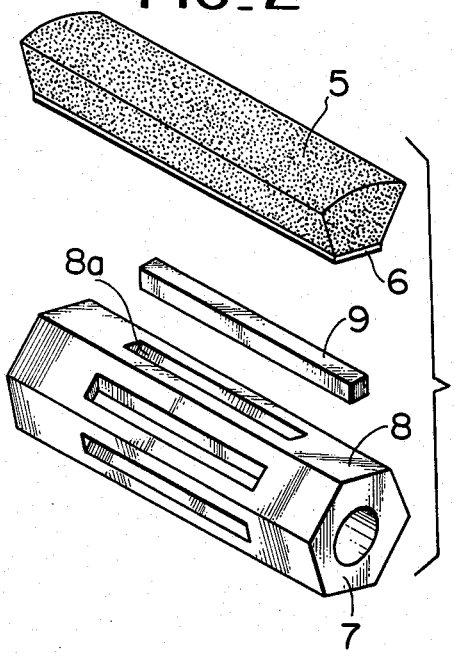
FIG. 2 is an exploded view of an ink impregnated platen.
Figure 3:
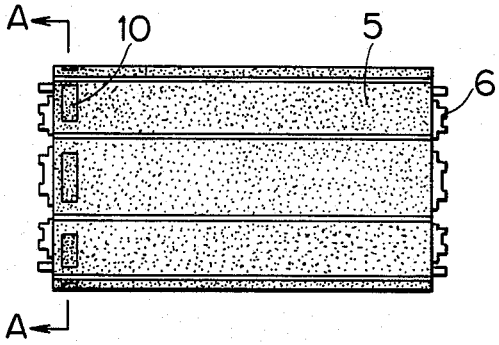
FIGS. 3 and 4 show a first embodiment of the invention.
Figure 4:
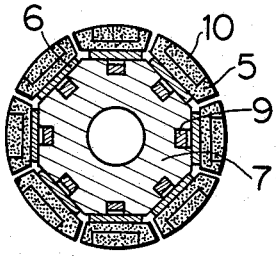

FIG. 3 shows a front view of the ink impregnated platen, showing the first embodiment of the invention, and FIG. 4 is a cross sectional view seen from A—A in FIG. 3 where high density porous parts 10 are furnished as the printing color indicating members in the non-printing parts of the ink impregnated bodies 5.

The porous body 5 is, as mentioned above, composed of the sintered material having a polyamide resin 0.70 to 0.85. If the sintered body is provided, at its non-printing part, with a sintered portion 10 having a natural color of higher density such as 0.90 to 1.0, the higher density sintered body absorbs less than the ink impregnating amount, and it takes on a degree of the color similar to that in the printing paper.

The thus constructed ink impregnated porous body 5 is designated with the printing color for the paper by means of the higher density porous portion, and it is easy to choose the porous body 5 of the desired color.

Figure 5:
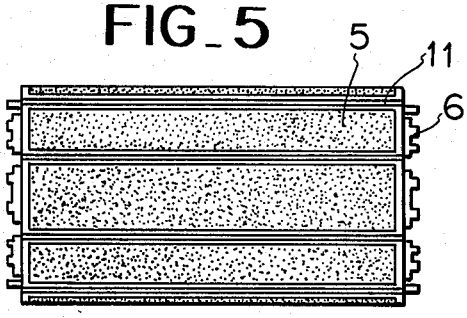
FIG. 5 shows a second embodiment of the invention.

FIG. 5 is a front view of the ink impregnated platen showing a second embodiment where the porous body 5 is attached, at its non-printing portion, with a tape 11 of a printing color.

Figure 6:
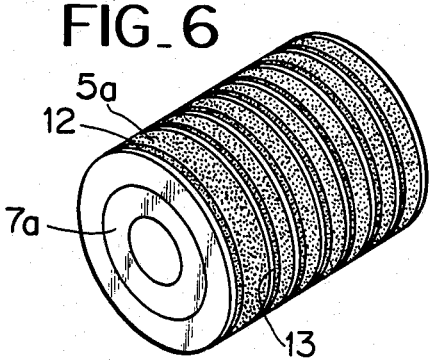
FIG. 6 shows a third embodiment of the invention.

FIG. 6 is a perspective view of the ink impregnated platen showing a third embodiment where a platen base 7*a* of cylindrical shape is furnished with ink impregnated porous bodies 5*a* having a ring shape and separated by partitions 13. The printing color indicating member of this structure is a high density porous body 12 of a thin ring shaped material held between the partition 13 and the porous body 5*a*.

The high density porous body 12 of the thin ring shaped material serves as the printing color indicating member, and is, similar to the first embodiment, made of sintered material of polyamide resin of natural color of higher density than the porous body 5*a*, and if the ink is impregnated therein, the high density porous body 12 takes on a similar degree of the color as in the printing paper.

As mentioned above, the printing color indicating member is furnished to the non-printing portion of the ink impregnated body so that the printing color can be exactly designated to the printing paper, and the body of the desired color may be easily chosen, irrespectively of the colored outer appearance of the ink impregnated porous body.

The resin is not limited to polyamide, and if the high density porous material of synthetic resin of natural color is applied for the ink impregnated body as the printing color indicating member, the color indication could be provided easily and conveniently by impregnating the ink into the porous substance.

We claim:

1. An ink impregnated platen of a printer having a printing head, comprising: a platen base arranged opposite to said printing head and rotatable with respect to said printing head; a plurality of porous bodies made of a sintered resin and having a first density for absorbing inks of different colors, each of said bodies having a non-printing portion; means for detachably attaching said porous bodies to said platen base; a plurality of porous ink color indicating members made of the same sintered resin as said porous bodies and having a second density for absorbing inks of different colors, the second density of said indicating members being higher than the first density of said porous bodies, one of said ink color indicating members being embedded in each of said porous bodies at said non-printing portion thereof.

2. A platen as defined in claim 1, wherein said sintered material is a polyamide resin.

3. A platen defined in claim 2, wherein said first density of said porous bodies is 0.70 to 0.85, and said second density of said color indicating members is 0.90 to 1.0.

4. A platen as defined in claim 1; and further comprising a plurality of ring-shaped partitions, wherein said platen body has a cylindrical shape, said porous bodies having a ring-shape so as to be stackable on said platen body, said ring-shaped partitions being mountable on said platen body so as to separate said porous bodies.

* * * * *